US011403927B2

(12) United States Patent
Siao et al.

(10) Patent No.: US 11,403,927 B2
(45) Date of Patent: Aug. 2, 2022

(54) ADJUSTABLE ELECTRONIC TAG DEVICE FOR A SUITCASE

(71) Applicant: NETRONIX, INC., Jubei (TW)

(72) Inventors: Tong-Yun Siao, Hsinchu (TW); Keng-Feng Lin, Jubei (TW); Chien-Te Hsieh, Taichung (TW)

(73) Assignee: Netronix, Inc., Jubei (TW)

( * ) Notice: Subject to any disclaimer, the term of this patent is extended or adjusted under 35 U.S.C. 154(b) by 404 days.

(21) Appl. No.: 16/689,418

(22) Filed: Nov. 20, 2019

(65) Prior Publication Data

US 2021/0049884 A1 Feb. 18, 2021

(30) Foreign Application Priority Data

Aug. 15, 2019 (TW) ..... 108210801

(51) Int. Cl.

| | |
|---|---|
| ***G08B 13/24*** | (2006.01) |
| ***A45C 13/42*** | (2006.01) |
| ***G09F 3/03*** | (2006.01) |
| ***G09F 3/20*** | (2006.01) |
| ***G09F 3/02*** | (2006.01) |

(52) U.S. Cl.

CPC ..... *G08B 13/2434* (2013.01); *A45C 13/42* (2013.01); *G09F 3/037* (2013.01); *G09F 3/0388* (2013.01); *G09F 3/201* (2013.01); *G09F 2003/0254* (2013.01)

(58) Field of Classification Search

CPC ..... G09F 3/0388; G09F 3/201; G09F 2003/0254; G09F 3/0382; G09F 3/14; G09F 3/037; G09F 3/0297; G09F 3/10; G09F 2003/0272; G09F 3/20; A45C 13/42; Y10T 24/1498; B65D 63/1027; B65D 63/1036; B65D 63/1045; B65D 63/1054; B65D 63/1063; B65D 63/1072; B65D 63/1081

See application file for complete search history.

(56) References Cited

U.S. PATENT DOCUMENTS

| | | | | |
|---|---|---|---|---|
| 9,068,674 | B1 * | 6/2015 | Mangone, Jr. ..... | F16L 3/2332 |
| 10,121,101 | B1 * | 11/2018 | Warther ..... | A45C 13/42 |
| 2005/0193783 | A1 * | 9/2005 | Zovic ..... | G09F 3/0352 70/69 |

FOREIGN PATENT DOCUMENTS

| | | | | |
|---|---|---|---|---|
| CN | 101635116 | A * | 1/2010 | |
| EP | 1768080 | A1 * | 3/2007 | ..... G09F 3/037 |
| GB | 2535520 | A * | 8/2016 | ..... A45C 13/42 |

OTHER PUBLICATIONS

Xiao, Yanquan. NPL of Translated Foreign Patent CN101635116A. Jul. 21, 2008. (Year: 2008).*

* cited by examiner

*Primary Examiner* — Jonathan Liu
*Assistant Examiner* — Rachel Mae Griffith
(74) *Attorney, Agent, or Firm* — Rosenberg, Klein & Lee

(57) ABSTRACT

An adjustable electronic tag device for a suitcase or luggage includes an electronic tag provided with a fixing assembly thereon. The fixing assembly fixes the electronic tag to the suitcase. The fixing assembly includes a positioning member including a binding hole and a movable fastener arranged in the binding hole. The positioning member connects with an end of a binder and another of the binder encircles the suitcase and penetrates through the binding hole. The binder has a plurality of bars arranged in rows, and the movable fastener is fastened with at least one of the plurality of bars to fix the binder.

6 Claims, 4 Drawing Sheets

ADJUSTABLE ELECTRONIC TAG DEVICE FOR A SUITCASE

This application claims priority for Taiwan (R.O.C.) patent application no. 108210801 filed on Aug. 15, 2019, the content of which is incorporated by reference in its entirely.

BACKGROUND OF THE INVENTION

Field of the Invention

The present invention relates to a device for recognizing data, particularly to an adjustable electronic tag device for a suitcase or luggage.

Description of the Related Art

Passengers and their suitcases are required to check in at the counter before boarding the plane. When checking in the suitcases, paper-made labels are manually wrapped and pasted on the suitcases to help recognize the suitcases.

However, due to the consideration of reducing the waiting time of passengers, airlines have begun to provide a self-help check-in suitcase service. Although the service can reduce the waiting time of passengers, the passengers need to print paper-made labels and manually wrap and paste the labels on the suitcases. The paper-made labels are used only once and can be easily worn and scratched. More importantly, as soon as the quality for printing paper-made labels is bad, the success rate for reading the labels is compromised, causing incorrect distributing that leads to increasing handling time and cost.

In order to solve the problem with paper-made labels, manufacturers have developed electronic tags and embedded them into suitcases. Users control electronic tags to display the image of labels for suitcases using application programs and the wireless transmitting technology, thereby solving the problem with paper-made labels. Now manufacturers even developed externally-mounted electronic tags since the process for embedding electronic tags into suitcases is more complicated: a double-sided tape is used to secure the electronic tag to the suitcase. Alternatively, a strap is used to hang the electronic tag on the handle of the suitcase. Nevertheless, the electronic tag fixed to the suitcase through the double-sided tape easily drops off. The tightness of hanging the electronic tag on the handle of the suitcase cannot be adjusted according to the size of the handle, such that the electronic tag easily shakes. When the collision of the suitcase occurs to easily apply larger force to the electronic tag, the probability of damaging the electronic tag is easily increased.

To overcome the abovementioned problems, the present invention provides an adjustable electronic tag device for a suitcase, so as to solve the afore-mentioned problems of the prior art.

SUMMARY OF THE INVENTION

The primary objective of the present invention is to provide an adjustable electronic tag device for a suitcase, which fixes an electronic tag to the suitcase to recognize the suitcase, and freely adjusts the tightness of fixing the electronic tag. When the suitcase moves, the adjustable electronic tag device is stably arranged on the suitcase without shaking.

Another objective of the present invention is to provide an adjustable electronic tag device for a suitcase, which uses a security mechanism to prevent from freely adjusting an electronic tag and stealing the electronic tag.

Further objective of the present invention is to provide an adjustable electronic tag device for a suitcase, which has a simple structure and high production efficiency, thereby reducing the fabrication cost.

To achieve the abovementioned objectives, the present invention provides an adjustable electronic tag device for a suitcase, which comprises an electronic tag and a fixing assembly. The fixing assembly, arranged on the electronic tag, fixes the electronic tag to the suitcase. The fixing assembly comprises a positioning member and a binder. The positioning member includes a binding hole and a movable fastener arranged in the binding hole. An end of binder connects with the positioning member and another end of the binder encircles the suitcase and penetrates through the binding hole. The binder has a plurality of bars arranged in rows, and the movable fastener is fastened with at least one of the plurality of bars to fix the binder.

In an embodiment of the present invention, the fixing assembly further comprises a case encapsulating the positioning member, a bottom of the case is provided with a first opening hole, two sides of the case are respectively provided with a second opening hole and a third opening hole, the second opening hole, the third opening hole, and the binding hole are coaxially arranged, the binder emerges from the first opening and sequentially penetrates through the second opening hole, the binding hole of the positioning member, and the third opening hole.

In an embodiment of the present invention, two ends of the movable fastener are fixed to an inner sidewall of the binding hole, a top and a bottom of the movable fastener respectively have a pressing portion and a tooth-like fastening portion, and when the pressing portion is pressed, the tooth-like fastening portion leaves from at least one of the plurality of bars to move the binder in the binding hole.

In an embodiment of the present invention, the case is provided with an anti-theft through hole, the anti-theft through hole and the pressing portion are coaxially arranged, the pressing portion is pressed through the anti-theft through hole to leave the tooth-like fastening portion from the at least one of the plurality of bars.

Below, the embodiments are described in detail in cooperation with the drawings to make easily understood the technical contents, characteristics and accomplishments of the present invention.

DETAILED DESCRIPTION OF THE INVENTION

The present invention provides an adjustable electronic tag device for a suitcase or luggage. The adjustable electronic tag device, arranged on the suitcase, is able to display the barcode of the suitcase before boarding the plane. The adjustable electronic tag device of the present invention freely adjusts the tightness of fixing an electronic tag to the suitcase. When the suitcase moves, the adjustable electronic tag device is stably arranged on the suitcase without shaking, thereby reducing the probability of colliding with and causing damage to the electronic tag.

Figure 1:
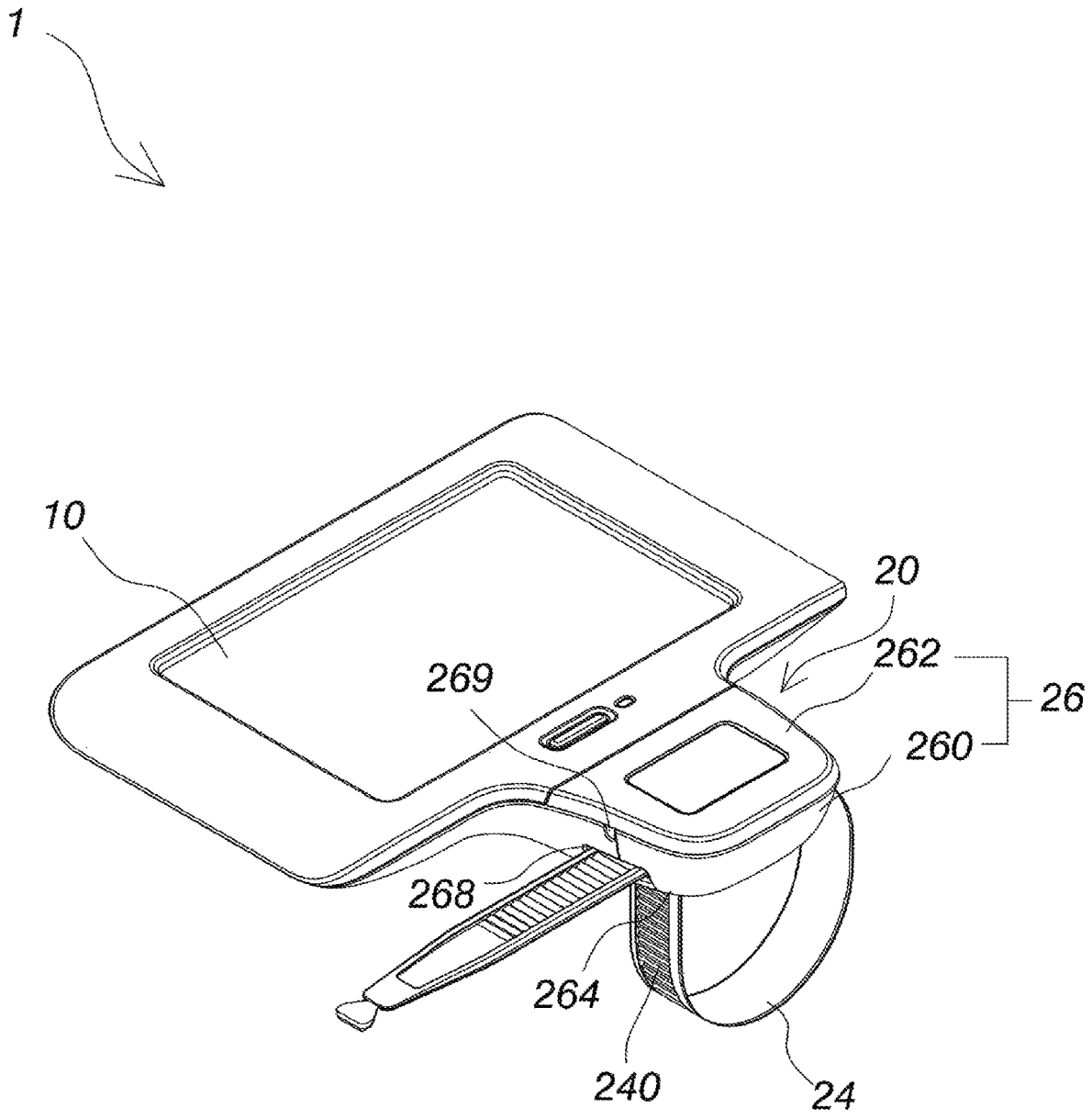
FIG. 1 is a perspective view of an adjustable electronic tag device according to an embodiment of the present invention.
Figure 2:
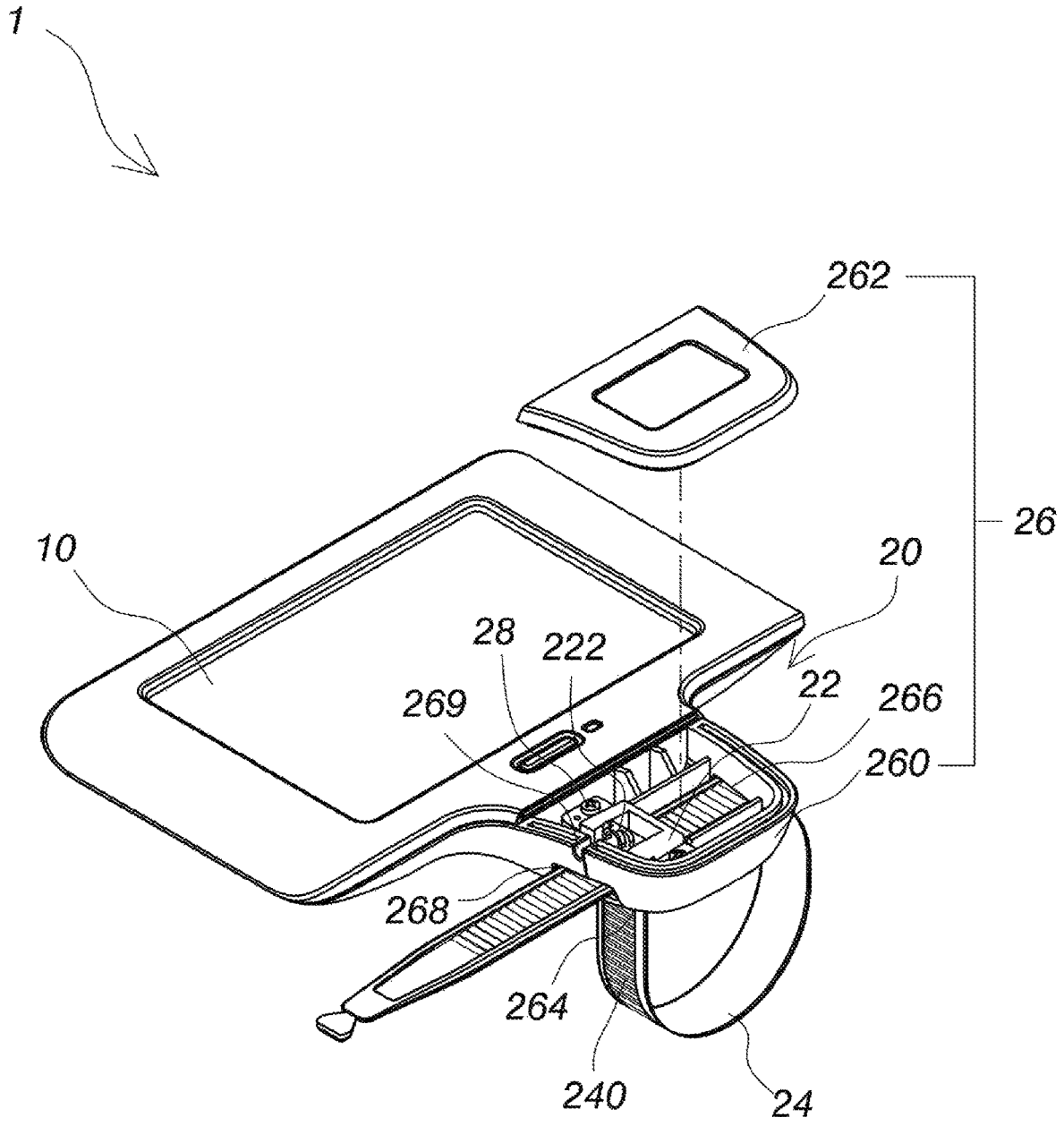
FIG. 2 is a diagram schematically illustrating an adjustable electronic tag device when a cover is opened according to an embodiment of the present invention.
Figure 3:
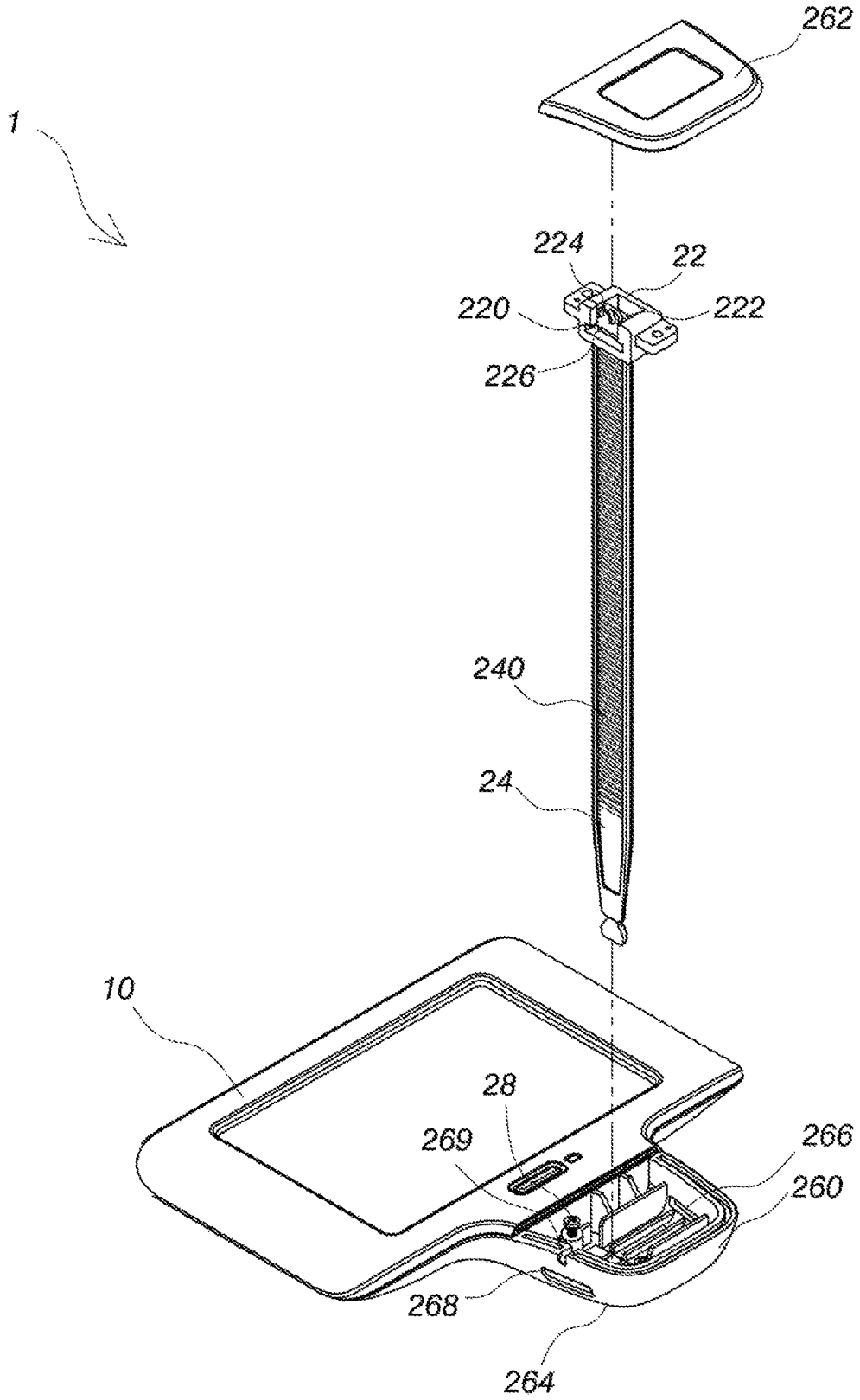
FIG. 3 is an exploded view of an adjustable electronic tag device according to an embodiment of the present invention.
Figure 4:
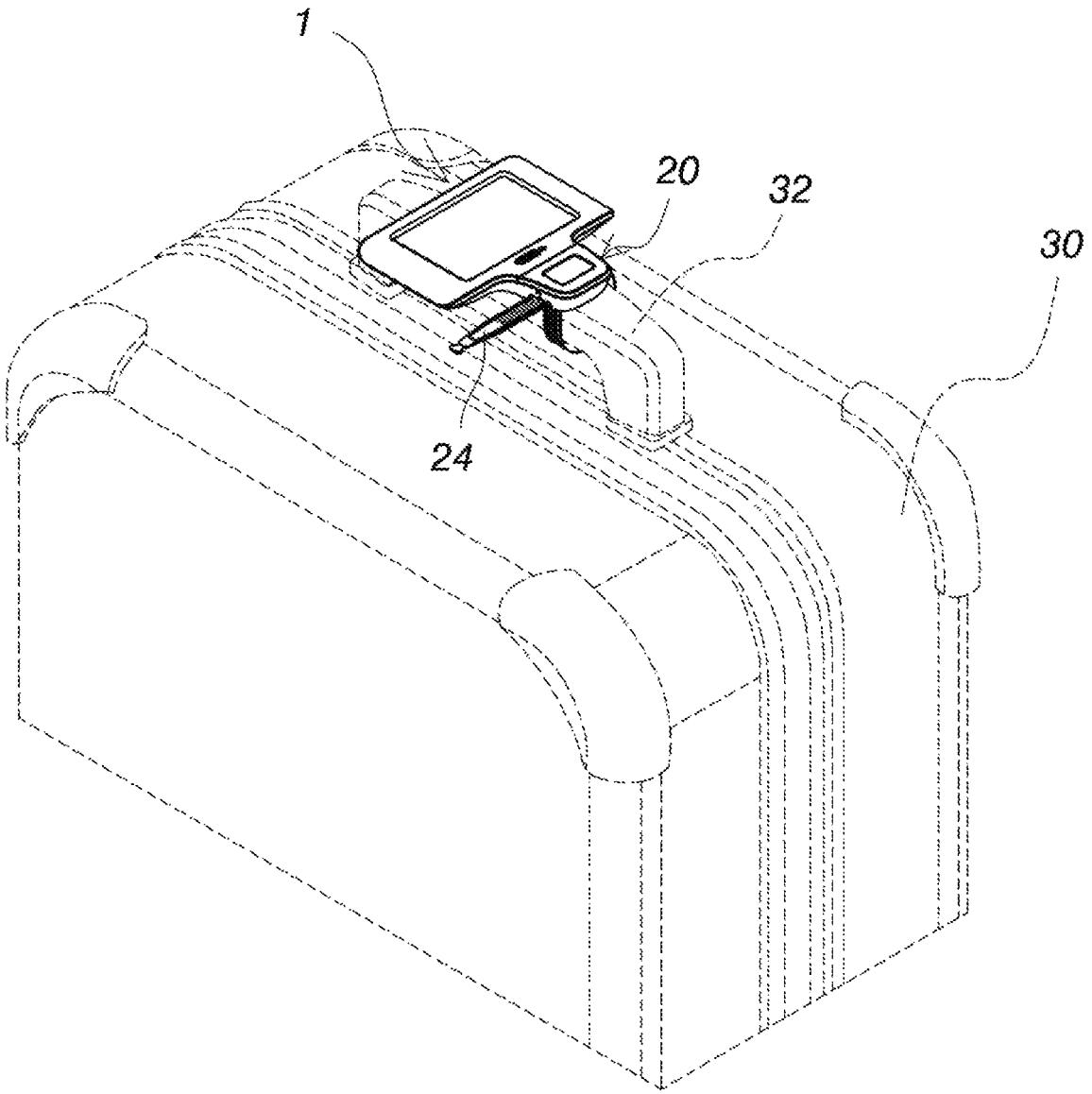
FIG. 4 is a diagram schematically illustrating a state of using an adjustable electronic tag device according to an embodiment of the present invention.

Refer to FIG. 1, FIG. 2, and FIG. 3. The structure of the adjustable electronic tag device 1 is introduced as follows. The adjustable electronic tag device 1 comprises an electronic tag 10 exemplified by an electronic paper. The electronic tag 10 is provided with a fixing assembly 20 thereon. The electronic tag 10 may be fixed to the handle (not shown) of the suitcase through the fixing assembly 20. The fixing assembly 20 includes a positioning member 22, a binder 24, and a case 26.

Refer to FIG. 3. The positioning member 22 is a soft positioning member, such as a plastic positioning member. The positioning member 22 includes a binding hole 220 and a movable fastener 222 arranged in the binding hole 220. Two ends of the movable fastener 222 are fixed to the inner sidewall of the binding hole 220. The top and the bottom of the movable fastener 222 respectively have a pressing portion 224 and a tooth-like fastening portion 226. At least one surface of the binder 24 has a plurality of bars 240 arranged in rows. An end of the binder 24 connects with the positioning member 22 and another end of the binder 24 encircles the handle of the suitcase and penetrates through the binding hole 220. When the binder 24 penetrates through the binding hole 220, the tooth-like fastening portion 226 of the movable fastener 222 is fastened with at least one of the plurality of bars 240 to fix the binder 24. When a user looses the binder 24, the user presses the pressing portion 224, such that the tooth-like fastening portion 226 leaves from at least one of the plurality of bars 240 of the binder 24 to move the binder 24 in the binding hole 220 of the positioning member 22.

Refer to FIG. 1, FIG. 2, and FIG. 3. The structure of the case 26 of the fixing assembly 20 is introduced as follows. The embodiment exemplifies the case 26 by a plastic case. The case 26 further comprises an accommodating case 260 and a cover 262, and the accommodating case 260 is covered with the cover 262. The case 26 may encapsulate the positioning member 22. The positioning member 22 is screwed to the accommodating case 260 of the case 26 by at least one fixing component 28, such as a screw. The cover 262 covers the accommodating case 260 to encapsulate the positioning member 22. The accommodating case 260 of the case 26 is provided with a first opening hole 264, a second opening hole 266, and a third opening hole 268. The bottom of the accommodating case 260 of the case 26 is provided with the first opening hole 264. The two sides of the accommodating case 260 of the case 26 are respectively provided with the second opening hole 266 and the third opening hole 268. When the positioning member 22 is fixed in the accommodating case 260, the binder 24 may emerge from the first opening hole 264. Simultaneously, the second opening hole 266, the third opening hole 268, and the binding hole 220 of the positioning member 22 are coaxially arranged. Thus, the binder 24 sequentially penetrates through the second opening hole 266, the binding hole 220 of the positioning member 22, and the third opening hole 268. The case 26 is provided with an anti-theft through hole 269. The anti-theft through hole 269 and the pressing portion 224 of the positioning member 22 are coaxially arranged. The diameter of the anti-theft through hole 269 is less than or equal to 0.2 cm. When a user intends to loose the binder 24, the user uses a fine needle to penetrate through the anti-theft through hole 269 to press the pressing portion, thereby leaving the tooth-like fastening portion 226 from the at least one of the plurality of bars 240 of the binder 24. As a result, the binder 24 moves in the binding hole 220 to adjust the tightness of the binder 24.

Refer to FIG. 1, FIG. 2, FIG. 3, and FIG. 4. The state of using the adjustable electronic tag device is introduced as follows. For example, the handle 32 of the suitcase 30 is installed with the adjustable electronic tag device 1. When the adjustable electronic tag device 1 is fixed, the binder 24 encircles the handle 32 of the suitcase 30 and sequentially penetrates through the second opening hole 266 and the binding hole 220 of the positioning member 22, such that the tooth-like fastening portion 226 of the movable fastener 222 is fastened with the bar 240 of the binder 24, thereby fixing the binder 24. When the user disassembles the adjustable electronic tag device 1, the user uses a fine needle to penetrates through the anti-theft through hole 269 of the case 26, thereby pressing the pressing portion 224 of the movable fastener 222. Thus, the tooth-like fastening portion 226 leaves from the bar 240 of the binder 24 to move the binder 24 in the binding hole 220, thereby loosing the binder 24. Then, the adjustable electronic tag device 1 is disassembled from the handle 32 of the suitcase 30.

In conclusion, the present invention freely adjusts the tightness of fixing the electronic tag. When the suitcase moves, the adjustable electronic tag device is stably arranged on the suitcase without shaking. The present invention uses a security mechanism to prevent from freely adjusting an electronic tag and stealing the electronic tag. In addition, the present invention has a simple structure and high production efficiency, thereby reducing the fabrication cost.

The embodiments described above are only to exemplify the present invention but not to limit the scope of the present invention. Therefore, any equivalent modification or variation according to the shapes, structures, features, or spirit disclosed by the present invention is to be also included within the scope of the present invention.

What is claimed is:

1. An adjustable electronic tag device for a suitcase, comprising:

an electronic tag; and a fixing assembly, arranged on the electronic tag, adapted to fix the electronic tag to a suitcase, and the fixing assembly comprises:

a positioning member including a binding hole and a movable fastener arranged in the binding hole; and a binder with an end thereof connecting with the positioning member and another end thereof adapted to encircle a suitcase and penetrating through the binding hole, the binder has a plurality of bars arranged in rows, and the movable fastener is fastened with at least one of the plurality of bars to fix the binder;

wherein the fixing assembly further comprises a case encapsulating the positioning member, a bottom of the case is provided with a first opening hole, two sides of the case are respectively provided with a second opening hole and a third opening hole, the second opening hole, the third opening hole, and the binding hole are coaxially arranged, the binder emerges from the first opening and sequentially penetrates through the second opening hole, the binding hole of the positioning member, and the third opening hole;

wherein two ends of the movable fastener are fixed to an inner sidewall of the binding hole, a top and a bottom of the movable fastener respectively have a pressing portion and a tooth-like fastening portion, and when the pressing portion is pressed, the tooth-like fastening portion leaves from the at least one of the plurality of bars to move the binder in the binding hole;

wherein the case is provided with an anti-theft through hole, the anti-theft through hole and the pressing portion are coaxially arranged, the pressing portion is pressed through the anti-theft through hole to leave the tooth-like fastening portion from the at least one of the plurality of bars.

2. The adjustable electronic tag device of claim 1, wherein the positioning member is fixed to the case using at least one fixing component.

3. The adjustable electronic tag device of claim 2, wherein the at least one fixing component is a screw.

4. The adjustable electronic tag device of claim 1, wherein the case further comprises an accommodating case and a cover, and the accommodating case is covered with the cover.

5. The adjustable electronic tag device of claim 1, wherein the positioning member is a plastic positioning member.

6. The adjustable electronic tag device of claim 1, wherein the case is a plastic case.

* * * * *